US006343483B1

(12) United States Patent
Armstrong

(10) Patent No.: US 6,343,483 B1
(45) Date of Patent: Feb. 5, 2002

(54) COOLING APPARATUS AND METHOD FOR VENDING MACHINES

(76) Inventor: Mark A. Armstrong, 2204 39th St. West, Bradenton, FL (US) 34205

( * ) Notice: Subject to any disclaimer, the term of this patent is extended or adjusted under 35 U.S.C. 154(b) by 0 days.

(21) Appl. No.: 09/729,029

(22) Filed: Dec. 4, 2000

(51) Int. Cl.[7] ..... F25D 17/04
(52) U.S. Cl. ..... 62/407; 62/419; 62/255
(58) Field of Search ..... 62/407, 419, 255

(56) References Cited

U.S. PATENT DOCUMENTS

| | | | | |
|---|---|---|---|---|
| 3,777,506 A | | 12/1973 | Hergatt et al. | |
| 4,685,311 A | * | 8/1987 | Rastelli | 62/258 |
| 4,872,320 A | | 10/1989 | Ishizaka et al. | |
| 5,007,249 A | * | 4/1991 | Van Druff, Jr. | 62/255 |
| 5,448,896 A | * | 9/1995 | Rushing | 62/255 |
| 5,584,191 A | * | 12/1996 | Kwon | 62/417 |
| 5,816,068 A | * | 10/1998 | Oh et al. | 62/407 |
| 5,875,645 A | * | 2/1999 | Dunnigan | 62/407 |
| 5,911,744 A | | 6/1999 | Kawaguchi | |
| 6,170,280 B1 | * | 1/2001 | Vachez | 62/255 |

* cited by examiner

*Primary Examiner*—William Doerrler
*Assistant Examiner*—Mark Shulman
(74) *Attorney, Agent, or Firm*—Charles J. Prescott

(57) ABSTRACT

A prepackaged food vending machine limited cooling apparatus and method for food vending machines of the type used for storing and dispensing prepackaged foods at normal room temperatures. The apparatus includes an elongated air conduit connected at one end thereof to, and in airflow communication with an interior of, the food vending machine. Another end of the air conduit connected to, and in airflow communication with a refrigerated interior of, a cold beverage vending machine. An airflow device, e.g. a blower or axial fan, is positioned in air flow communication between the interiors of the food and beverage vending machines whereby cold air within the beverage vending machine is transferred through the air conduit to the interior of the food vending machine in an airflow volume sufficient to reduce the air temperature within the food vending machine to a predetermined temperature below room temperature toward the operating temperature within the interior of the refrigerated beverage vending machine.

4 Claims, 4 Drawing Sheets

COOLING APPARATUS AND METHOD FOR VENDING MACHINES

BACKGROUND OF THE INVENTION

1. Scope of Invention

This invention relates generally to refrigerating and cooling methods and apparatus for food and beverage vending machines, and more particularly to an apparatus and method for transferring cold air from a cold beverage vending machine into a food vending machine for dispensing prepackaged snacks which normally operates at an interior temperature generally equal to that of room temperature.

2. Prior Art

Food and beverage vending machines have grown in popularity and are to be found in most common and commercial areas of many public and business settings. In many cases, these vending machines are placed outside and in easy access to the public or may be placed within a non-air conditioned building such as in a utility area. One typical class of vending machines dispenses cold beverages within sealed containers such as aluminum cans or plastic or glass containers and the like. The beverage contents are maintained at a refreshingly cold temperature in the range of about 40° F. to 50° F. Another popular vending machine type holds and dispenses prepackaged food snacks such as candy bars, pretzels, peanuts, potato chips, etc. at room temperature.

Vending machine operators and owners prefer to economize on available space by placing two or more vending machines dispensing a variety of food and beverage products adjacent one another. During the summer heat, temperatures within the non-refrigerated prepackaged food vending machines may rise to temperatures sufficient to cause deterioration or melting of a portion of the contents of the prepackaged foods such as chocolate coverings on candy bars. Because the food vending machines are not refrigerated, certain foods held therein for dispensing therefore may become spoiled or deteriorated.

A refrigerating method and apparatus for showcases and vending machines is disclosed by Kawaguchi in U.S. Pat. No. 5,911,744. This disclosure teaches the circulation of air through feeding piping, the air being cooled by a separate refrigeration unit.

Hergatt, et al., in U.S. Pat. No. 3,777,506, teaches a portable air conditioner for cooling the interior of recreational vehicles via attachment to a window of such vehicles. Complex structural adaptation allows for the interconnection with the exterior of the window while the portable unit sits and operates outside of the recreational vehicle during its operation.

In U.S. Pat. No. 4,872,320, Ishizaka, et al. also teaches a refrigeration showcase which circulates air by an upright air duct from a base unit which encloses the refrigeration components and an upper covered display table which defines a commodity chamber.

The present invention in its uniquely simplistic form provides an apparatus for the transfer of cold air from within a cold beverage vending machine into the interior area of a prepackaged food vending machine which normally operates at room temperature in its interior volume. A small blower connected within the air transfer conduit between the two adjacent vending machines draws the cold air into the interior volume of the food vending machine on a temperature-regulated basis. The apparatus is intended to draw the interior volume air temperature of the prepackaged vending machine down to somewhat below a predetermined room temperature, but not down to the cold air temperature of the interior of the beverage vending machine.

BRIEF SUMMARY OF THE INVENTION

This invention is directed to a prepackaged food vending machine limited cooling apparatus and method for food vending machines of the type used for storing and dispensing prepackaged foods at normal room temperatures. The apparatus includes an elongated air conduit connected at one end thereof to, and in airflow communication with an interior of, the food vending machine. Another end of the air conduit connected to, and in airflow communication with a refrigerated interior of, a cold beverage vending machine. An airflow device or fan is positioned in air flow communication between the interiors of the food and beverage vending machines whereby cold air within the beverage vending machine is transferred through the air conduit to the interior of the food vending machine in an airflow volume sufficient to reduce the air temperature within the food vending machine to a predetermined temperature below room temperature toward the operating temperature in the interior of the beverage vending machine.

It is therefore an object of this invention to provide an economical apparatus and method for cooling the interior of a food vending machine by drawing cold air from an adjacent refrigerated cold beverage vending machine when ambient or room temperature is elevated to a temperature which would compromise or deteriorate prepackaged snack food integrity.

It is another object of this invention to provide an apparatus and method which cools the interior of a non-refrigerated food vending machine when ambient or room temperature becomes elevated to a temperature which may compromise the edibility of prepackaged snack foods contained within the food vending machine.

In accordance with these and other objects which will become apparent hereinafter, the instant invention will now be described with reference to the accompanying drawings.

DETAILED DESCRIPTION OF THE INVENTION

Figure 1:
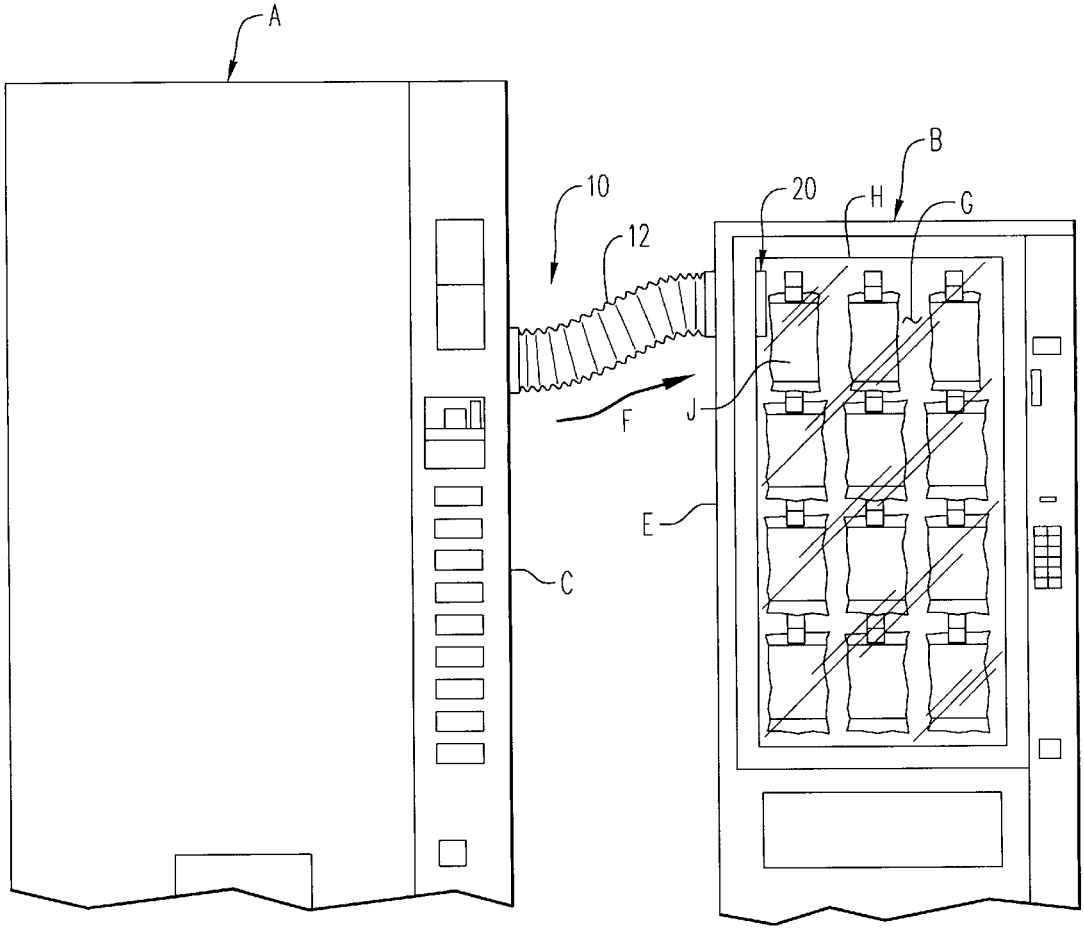
FIG. 1 is a front elevation view of the invention 10 operably connected between a cold beverage vending machine A and a snack food vending machine B.
Figure 2:
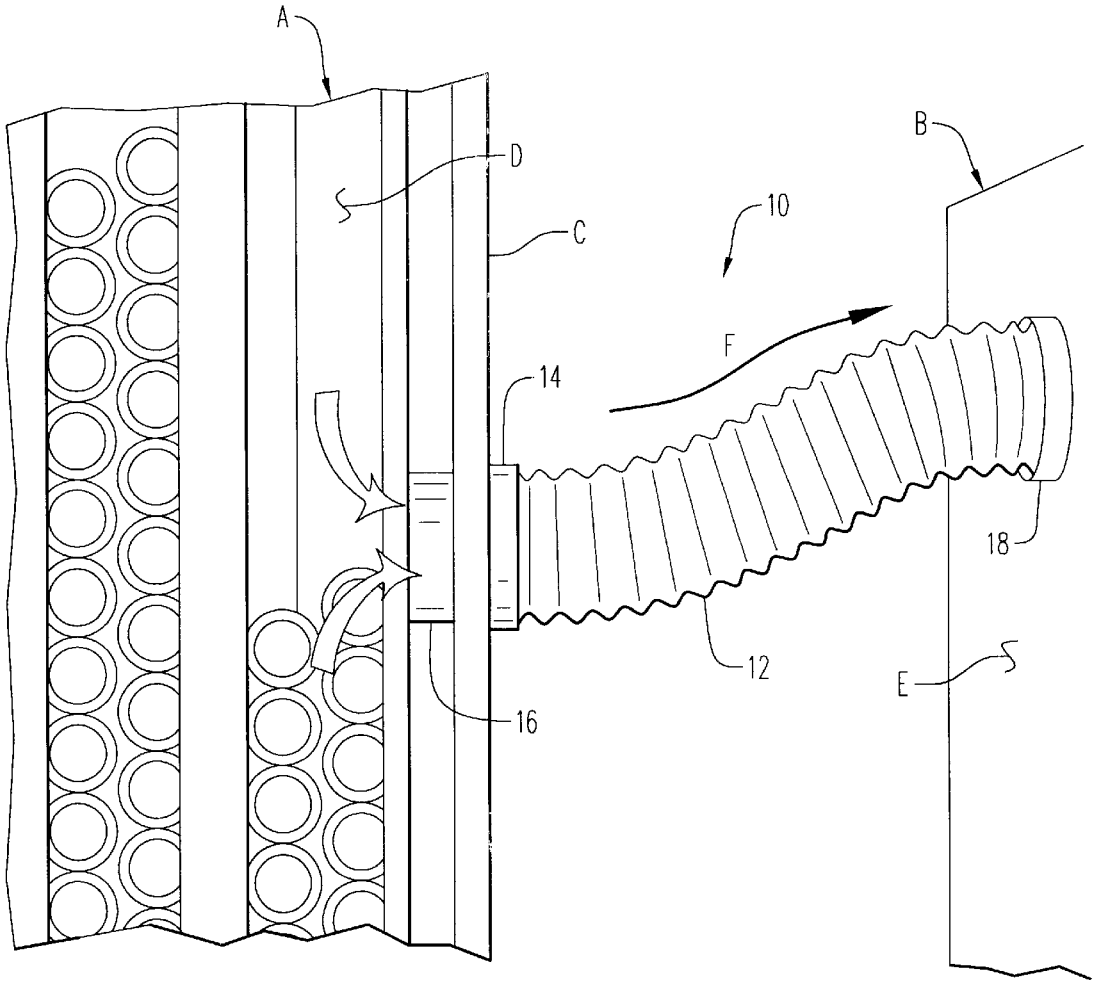
FIG. 2 is an enlarged view of the invention 10 with the door of the beverage vending machine A in an open position.

Referring now to the drawings, the invention 10 is shown in FIGS. 1 and 2 positioned between a refrigerated cold beverage vending machine A and a closely adjacent snack food vending machine B. The interior D of the beverage vending machine A is maintained by its own cooling apparatus (not shown) typically at a temperature of between 40° F. and 50° F. This cold temperature maintains the beverage contents of the prepackaged canned beverages shown at a refreshing temperature level.

The snack food vending machine B dispenses prepackaged snack foods shown typically at J such as candy bars, peanuts, pretzels, chewy candy, potato chips and the like. A typical dispensing support is shown at K in FIGS. 3 and 4. The interior G of the snack food vending machine B is self-maintaining at approximately room temperature without the aid of a separate refrigeration source or the present invention 10.

In many circumstances, the room or ambient temperature in which these vending machines A and B, typically placed in close proximity to one another for enhanced revenue, becomes elevated to temperature levels above that which is acceptable for maintaining the edibility and proper consistency of the prepackaged snack foods J. One particularly annoying problem with elevated temperatures is that chocolate on the snack foods will somewhat melt and cause the snack food to be messy to consume. In worst-case scenarios, and over prolonged periods, the prepackaged snack foods may also become inedible due to heat deterioration of the snack foods.

The invention 10 includes an elongated airflow conduit 12 which is connected at one end 14 to a side panel C of the cold beverage vending machine A. A collar 16 mounted within the interior D on the inner surface of the side panel C establishes airflow communication between the interior D and the air conduit 12. Another end 18 of the air conduit 12 is connected to a side panel E of the food vending machine B.

Figure 3:
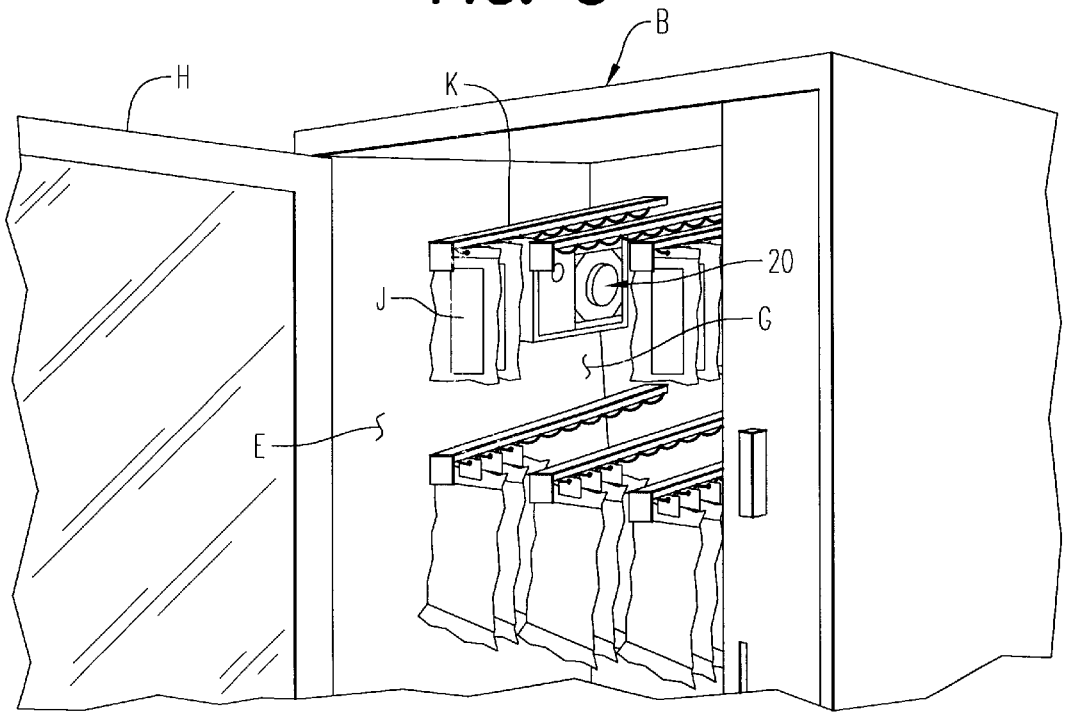
FIG. 3 is a perspective view of the food vending machine, door opened, and showing the airflow and temperature control unit 20 attached to an interior surface of the food vending machine B.
Figure 4:
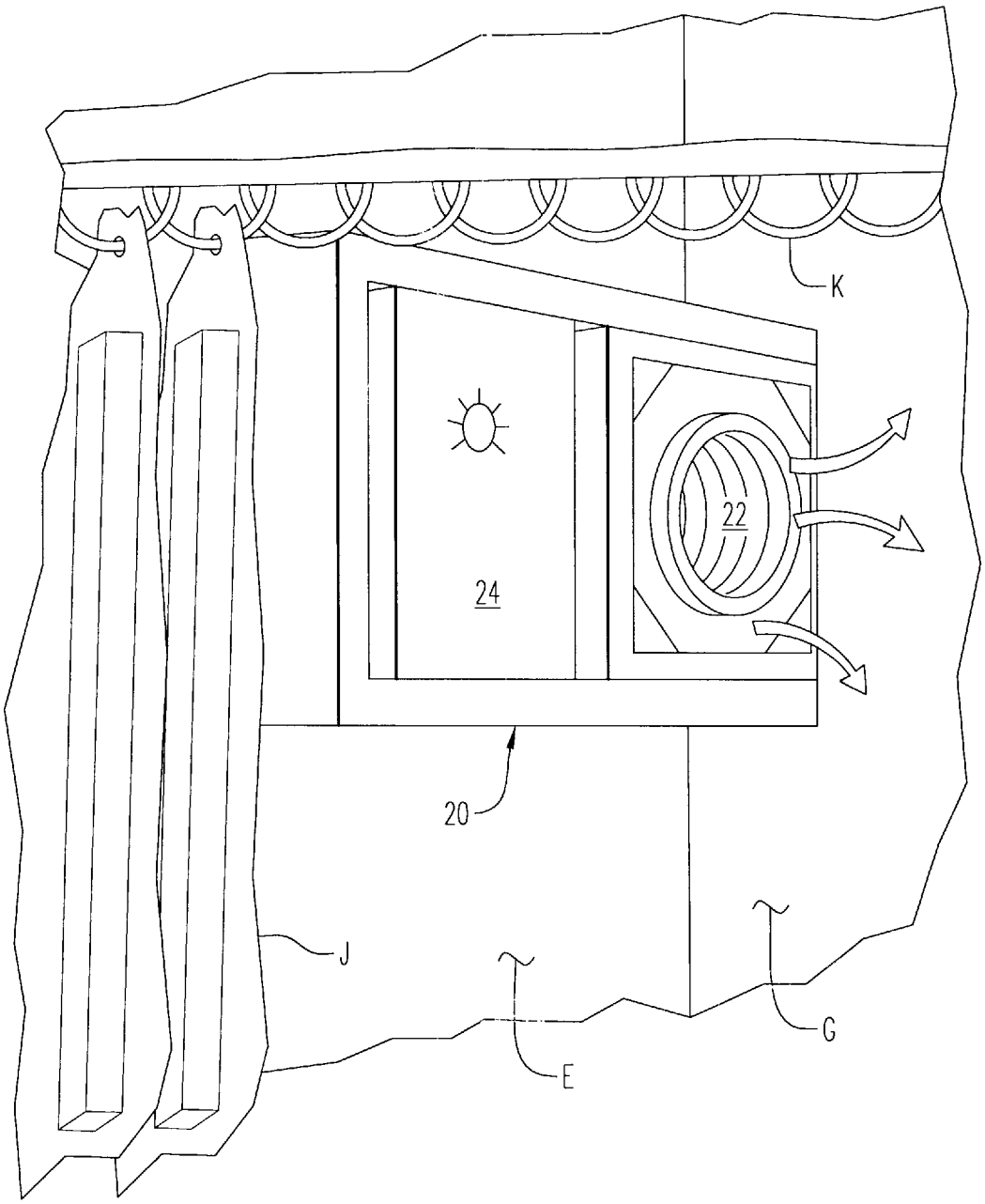
FIG. 4 is an enlarged view of a portion of FIG. 3.

As seen in FIGS. 3 and 4, the invention 10 also includes an airflow control member 20 which includes an airflow device 22 such as an axial flow fan and a temperature and control member 24 mounted on the interior surface of side panel E. When the airflow device 22 is operational, cold air is drawn from the interior D of the beverage vending machine A in the direction of the arrows in FIG. 2. Airflow continues in the direction of arrow F through the air conduit 12 and into the interior G of the food vending machine B.

Operation of the airflow device 22 is preferably controlled by temperature controller 24 which is preset to a desired temperature level at which the interior G will be maintained. This temperature level is established somewhat above the normal temperature within interior D of the beverage vending machine A, but somewhat below a predetermined excessive room temperature, e.g. 80° F., above which the integrity of at least a portion of the prepackaged food J would be compromised. Note, however, that in its simplest form, only an axial flow fan operated continuously or intermittently, is envisioned to be within the scope of this invention.

Because the prepackaged food J within the snack food vending machine B is quite stable at normal room temperatures of up to about 80° F., the apparatus 10 would only operate to draw cold air from the beverage vending machine A into the snack food vending machine B under conditions of such an elevated room or ambient temperatures, e.g. above 80° F.—85° F. A flow control valve (not shown) may be positioned within collar 16 such as that of a gravity or spring-operated damper flap which would substantially close the collar 16 to any cold air leakage from the interior D when the airflow device 22 is not in operation.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An apparatus for interconnecting a refrigerated interior of a cold beverage vending machine and an ambient or room temperature interior of a food vending machine, the food vending machine and the cold beverage machine normally operating independently and unconnected one to another, said apparatus comprising:

an elongated air conduit connectable at one end thereof to a panel or outside surface of the food vending machine and in airflow communication with the ambient or room temperature interior of the food vending machine;

another end of said air conduit connectable to a panel or outside surface of the cold beverage vending machine and in airflow communication with the refrigerated interior of a cold beverage vending machine when positioned adjacent to the food vending machine;

an airflow device positionable in air flow communication between the interiors of the food and beverage vending machines whereby cold air within the beverage vending machine is transferred by said airflow device into the interior of the food vending machine in an airflow volume sufficient to reduce the air temperature within the food vending machine to a temperature substantially below ambient or room temperature, but not down to, the normal operating temperature within the beverage vending machine.

2. A method of cooling an interior of a normally unrefrigerated prepackaged food vending machine, the food vending machine of the independently operating type for storing and dispensing prepackaged snack foods at normal ambient or room temperatures, comprising the steps of:

A. attaching one end of an elongated air conduit to a panel or outside surface of, and in airflow communication with, an interior of the food vending machine;

B. attaching another end of the air conduit to a panel or outside surface of the cold beverage vending machine in airflow communication with the refrigerated interior of the cold beverage vending machine after being positioned in proximity to the food vending machine;

C. connecting and operating an airflow device in air flow communication with the air conduit and between the interiors of the food and beverage vending machines whereby cold air within the beverage vending machine is transferred by operation of the airflow device to the interior of the food vending machine to reduce the air temperature within the food vending machine sufficiently to prevent heat deterioration of the prepackaged snack foods within the food vending machine.

3. A prepackaged food vending machine as set forth in claim 1, further comprising:

a temperature control unit operably connected to sense the air temperature within the interior of the food vending machine and to activate said airflow device during time periods when the temperature of the interior of the food vending machine is above a predetermined temperature.

4. A method as set forth in claim 2, further comprising the step of:

D. sensing the air temperature within the interior of the food vending machine and operating said airflow device as in Step C during time periods when the temperature of the interior of the food vending machine is above a predetermined temperature.

* * * * *